US009475994B2

(12) United States Patent
Esmaeili et al.

(10) Patent No.: US 9,475,994 B2
(45) Date of Patent: Oct. 25, 2016

(54) ENHANCING FINE CAPTURE IN PARAFFINIC FROTH TREATMENT PROCESS

(75) Inventors: Payman Esmaeili, Houston, TX (US); Ronald D. Myers, Calgary (CA); Brian C. Speirs, Calgary (CA); Olusola B Adeyinka, Calgary (CA)

(73) Assignee: ExxonMobil Upstream Research Company, Spring, TX (US)

( * ) Notice: Subject to any disclaimer, the term of this patent is extended or adjusted under 35 U.S.C. 154(b) by 242 days.

(21) Appl. No.: 14/110,575

(22) PCT Filed: Mar. 9, 2012

(86) PCT No.: PCT/US2012/028563

§ 371 (c)(1),
(2), (4) Date: Oct. 8, 2013

(87) PCT Pub. No.: WO2012/151000

PCT Pub. Date: Nov. 8, 2012

(65) Prior Publication Data

US 2014/0048449 A1 Feb. 20, 2014

(30) Foreign Application Priority Data

May 3, 2011 (CA) ..... 2738560

(51) Int. Cl.
*C10G 1/04* (2006.01)
*C10G 1/00* (2006.01)

(52) U.S. Cl.
CPC ..... *C10G 1/045* (2013.01); *C10G 1/002* (2013.01); *C10G 1/047* (2013.01); *C10G 2300/206* (2013.01); *C10G 2300/44* (2013.01); *C10G 2300/805* (2013.01)

(58) Field of Classification Search
CPC ..... C10G 1/002; C10G 1/045; C10G 1/047; C10G 2300/206; C10G 2300/44; C10G 2300/805
See application file for complete search history.

(56) References Cited

U.S. PATENT DOCUMENTS

| | | | | |
|---|---|---|---|---|
| 3,935,076 A | | 1/1976 | Cymbalisty | |
| 4,240,897 A | | 12/1980 | Clarke | |
| 4,343,691 A | | 8/1982 | Minkkinen | |
| 4,561,965 A | | 12/1985 | Minkkinen | |
| 4,676,889 A | | 6/1987 | Hsieh et al. | |
| 5,236,577 A | * | 8/1993 | Tipman | C10G 1/047 208/390 |
| 5,876,592 A | | 3/1999 | Tipman et al. | |

(Continued)

FOREIGN PATENT DOCUMENTS

| | | |
|---|---|---|
| CA | 940853 | 1/1974 |
| CA | 2075108 | 1/1994 |

(Continued)

*Primary Examiner* — Prem C Singh
*Assistant Examiner* — Brandi M Doyle
(74) *Attorney, Agent, or Firm* — ExxonMobil Upstream Research Company Law Dept.

(57) ABSTRACT

A modified paraffinic froth treatment (PFT) process is described, in which a fine tailings stream obtained from a water extraction process practiced on oil sands is added during the treatment process. This modified process may be useful as a treatment for the fine tailings stream, allowing for the flocculation of the fines, thus reducing the volume of such fine tailings. The modified process may also be useful in that the fine tailings stream can be used as a supplement or a replacement for dilution water, thus eliminating or reducing the need for dilution water in the PFT process.

12 Claims, 2 Drawing Sheets

(56) References Cited

U.S. PATENT DOCUMENTS

| | | | | |
|---|---|---|---|---|
| 5,968,349 | A | 10/1999 | Duyvesteyn et al. | |
| 6,007,709 | A | 12/1999 | Duyvesteyn et al. | |
| 6,074,558 | A | 6/2000 | Duyvesteyn et al. | |
| 6,214,213 | B1 | 4/2001 | Tipman et al. | |
| 6,358,403 | B1 | 3/2002 | Brown et al. | |
| 6,358,404 | B1 | 3/2002 | Brown et al. | |
| 6,712,215 | B2 | 3/2004 | Scheybeler | |
| 6,800,116 | B2 | 10/2004 | Stevens et al. | |
| 7,067,811 | B2 | 6/2006 | Long et al. | |
| 7,141,162 | B2 | 11/2006 | Garner et al. | |
| 2003/0106860 | A1* | 6/2003 | Peloquin | B01D 21/0018 210/803 |
| 2005/0150844 | A1* | 7/2005 | Hyndman | C10G 1/045 210/750 |
| 2005/0263437 | A1 | 12/2005 | Howdeshell | |
| 2006/0113218 | A1 | 6/2006 | Hart et al. | |
| 2006/0138036 | A1 | 6/2006 | Garner et al. | |
| 2006/0138055 | A1 | 6/2006 | Garner et al. | |
| 2006/0260980 | A1 | 11/2006 | Yeung | |
| 2007/0111903 | A1 | 5/2007 | Engel et al. | |
| 2009/0200209 | A1 | 8/2009 | Sury et al. | |
| 2010/0187181 | A1* | 7/2010 | Sortwell | C22B 3/02 210/726 |
| 2010/0258308 | A1 | 10/2010 | Speirs et al. | |
| 2010/0282277 | A1 | 11/2010 | Chakrabarty et al. | |

FOREIGN PATENT DOCUMENTS

| | | |
|---|---|---|
| CA | 2149737 | 5/1995 |
| CA | 2217300 | 9/1997 |
| CA | 2200899 | 9/1998 |
| CA | 2232929 | 9/1998 |
| CA | 2353109 | 1/2003 |
| CA | 2471048 | 3/2004 |
| CA | 2527058 | 3/2004 |
| CA | 2505411 | 7/2004 |
| CA | 2425840 | 10/2004 |
| CA | 2435113 | 1/2005 |
| CA | 2490734 | 6/2005 |
| CA | 2454942 | 7/2005 |
| CA | 2455011 | 7/2005 |
| CA | 2726122 | 7/2005 |
| CA | 2750837 | 7/2005 |
| CA | 2750845 | 7/2005 |
| CA | 2750934 | 7/2005 |
| CA | 2750936 | 7/2005 |
| CA | 2750995 | 7/2005 |
| CA | 2751587 | 7/2005 |
| CA | 2751773 | 7/2005 |
| CA | 2799354 | 7/2005 |
| CA | 2799400 | 7/2005 |
| CA | 2799739 | 7/2005 |
| CA | 2750939 | 8/2005 |
| CA | 2520943 | 4/2006 |
| CA | 2502329 | 9/2006 |
| CA | 2538464 | 9/2006 |
| CA | 2493677 | 12/2006 |
| CA | 2521248 | 3/2007 |
| CA | 2587166 | 9/2007 |
| CA | 2612791 | 5/2008 |
| CA | 2674660 | 11/2009 |
| CA | 2714735 | 7/2011 |
| CA | 2729457 | 7/2011 |
| CA | 2733862 | 7/2011 |
| CA | 2806588 | 7/2011 |
| CA | 2806891 | 7/2011 |
| CA | 2719874 | 5/2012 |
| CA | 2733332 | 8/2012 |
| CA | 2735311 | 9/2012 |
| CA | 2736082 | 9/2012 |
| CA | 2737410 | 10/2012 |
| CA | 2738700 | 10/2012 |
| CA | 2805804 | 10/2012 |
| CA | 2815785 | 10/2012 |
| CA | 2739667 | 11/2012 |
| CA | 2740823 | 11/2012 |
| CA | 2740935 | 11/2012 |
| WO | WO 99/33936 | 7/1999 |

* cited by examiner

ENHANCING FINE CAPTURE IN PARAFFINIC FROTH TREATMENT PROCESS

CROSS-REFERENCE TO RELATED APPLICATIONS

This application is the National Stage of International Application No. PCT/US2012/028563 filed Mar. 9, 2012, which claims the benefit of Canadian patent application number 2,738,560 filed on May 3, 2011 entitled ENHANCING FINE CAPTURE IN PARAFFINIC FROTH TREATMENT PROCESS, the entirety of which is incorporated herein.

FIELD OF THE INVENTION

The present disclosure relates generally to the processing of mined oil sands. More particularly, the present disclosure relates to the treatment of fine tailings produced by water-based bitumen extraction processes.

BACKGROUND OF THE INVENTION

Oil sands are deposits comprised of bitumen, clay, sand and connate water, and make up a significant portion of North America's petroleum reserves. To produce a marketable hydrocarbon product from the oil sands, the bitumen must be extracted from the oil sands matrix. Because the bitumen itself is a tar-like, highly viscous material, separating it from the sands poses certain practical difficulties.

Bitumen Extraction Process:

An example of a common extraction technique is known as a water-based bitumen extraction process or a bitumen froth flotation, where hot water, air, and process aides are added to crushed ore at a basic pH to form a slurry. The slurry is sent to a primary separation vessel (PSV), which typically results in three streams including: (i) a bitumen froth stream, (ii) a coarse tailings stream, and (iii) a middlings stream. The bitumen froth stream is made up of bitumen, water and fine solids, and is formed from the buoyant bitumen-coated air bubbles rising through the slurry. The coarse tailings stream, also known as PSV underflow, is primarily made up of coarse solids (e.g. greater than 44 microns), some fine solids, and water. The coarse tailings stream is formed from the material that settles at the bottom of the PSV, and is discharged from the base of the vessel. A middlings stream, also known as fine tailings stream, may also be collected, comprising non-buoyant bitumen, water, and fine solids (e.g. less than 44 microns), from the middle of the PSV. In general, the middlings stream is subjected to a further froth flotation treatment to generate a secondary bitumen froth that is combined with the primary bitumen froth for further processing. This secondary treatment also generally produces a secondary tailings also known as fine tailings stream.

One problem with the water-based bitumen extraction process is the treatment of the fine tailings produced. The standard industry practice until now has been to pump oil sands tailings into large settling ponds—often discontinued mine pits. There, the heaviest material—mostly sand—settles to the bottom, separating from the top layer of water which can be recycled. The middle layer eventually settles to form what is known as mature fine tailings (MFT) which is comprised of about 70% water and 30% fine clay. Residual heat escapes into the atmosphere, while the tailings water is retained for future use, with some loss due to evaporation. This method is not optimal for at least three reasons. First, a significant amount of time is required for most of the solid materials to settle out of the fine tailings by operation of gravity alone; it can take decades for the fine particles to settle. Second, it does not allow for the recovery of the energy contained within the tailings stream in the form of heat. The fine tailing streams are often at temperatures between 35° C. and 90° C. Third, tailings ponds do not permit recovery of any of the residual hydrocarbon component (e.g. bitumen) within the tailings.

Several attempts to recover heat, water, and other reagents from tailings streams are known. Methods are disclosed in U.S. Pat. Nos. 4,343,691, 4,561,965 and 4,240,897, all to Minkkinen. These patents are directed to heat and water vapor recovery using a humidification/dehumidification cycle. U.S. Pat. No. 6,358,403 to Brown et al. describes a vacuum flash process used to recover hydrocarbon solvents from heated tailings streams. CA 2,674,660 describes the recovery of water from the tailings produced in PFT.

Paraffinic Froth Treatment:

The bitumen froth (i.e. the combination of the primary and secondary froth, discussed above) typically comprises bitumen (approximately 60% by weight), water (approximately 30% by weight), and solids (approximately 10% by weight). The water and solids in the froth are contaminants which need to be reduced in concentration before further treatment in a downstream refinery-type upgrading facility or shipped in a pipeline. This cleaning operation is carried out using what is referred to as "froth treatment".

Froth treatment is the process of reducing the aqueous and solid contaminants from the froth to produce a clean bitumen product. The froth is first diluted with a hydrocarbon solvent to reduce the viscosity and density of the oil phase, thereby accelerating the settling of the dispersed phase impurities by gravity or centrifugation. One such froth treatment process is known as paraffinic froth treatment (PFT), which involves the introduction of a paraffinic solvent (saturated aliphatic, such as a mixture of n-pentane and iso-pentane) as the hydrocarbon solvent. The bitumen product, called "diluted bitumen", which is often abbreviated to "dilbit", is then separated from diluted tailings, comprising water, solids, and some hydrocarbons. The solvent is recovered from the diluted bitumen to be used again.

The tailing from the PFT process (also called paraffinic froth treatment underflow (PFT underflow)) undergoes a further treatment to remove the solvent in a tailings solvent recovery unit (TSRU). A tailings solvent recovery unit (TSRU) utilizes heat to separate the hydrocarbon solvent from the particulate-containing water stream. Often, some of the tailings particulates remain in the TSRU, this accumulation of inorganic and organic solids resulting in the fouling or plugging of vessel internals, lines and valves. To reduce foaming and plugging within the TSRU, hot process water (e.g. 90° C.) (also called dilution water) is added to the PFT underflow before entering the TSRU.

The paraffinic froth treatment process may be carried out at high temperature (approximately 70-90° C.), and is then known as high temperature paraffinic froth treatment (HT-PFT). Paraffinic froth treatment has been discussed in the prior art, such as in Canadian Patent Nos. 2,149,737 (to Tipman and Long), 2,217,300 (to Shelfantook et al.), and 2,587,166 (to Sury).

One problem with the traditional PFT process includes the use of fresh water. This means that fresh water reserves are depleted. Other problems include plugging that occurs in the TSRU.

SUMMARY OF THE INVENTION

It is desirable to reduce the water requirements of the PFT process and mitigate foaming and plugging in the PFT process.

It is also desirable to reduce the environmental impact of such fine tailings.

It is also desirable to reduce heating requirements.

In a first aspect, the present disclosure provides a paraffinic froth treatment process wherein a fine tailings stream obtained from a water extraction process practiced on oil sands is added during the process.

In a further embodiment, there is provided a paraffinic froth treatment process, comprising providing a bitumen froth comprising bitumen (comprising both asphaltenes and maltenes), mineral solids, and water; adding a paraffinic solvent to the bitumen froth to form a solvent bitumen froth mixture; and processing the solvent bitumen froth mixture in at least a first settling unit such that at least a portion of the asphaltenes are precipitated with the mineral solids and residual water forming a diluted bitumen stream and a tailings stream; wherein a fine tailings stream obtained from a water extraction process practiced on oil sands is added during the process.

In a further aspect, the invention relates to a paraffinic froth treatment system. The system may be a plant located at or near a bitumen mining or recovery site or zone. The plant may include at least one froth settling unit (FSU) having a bitumen froth inlet for receiving bitumen froth (or a solvent froth-treated bitumen mixture) and a diluted bitumen outlet for sending diluted bitumen from the FSU. The plant further includes an inlet for adding a fine tailings stream obtained from a water extraction process practiced on oil sands. The plant may include more than one FSU, such as two FSUs. The plant may also include at least one tailings solvent recovery unit (TSRU), solvent storage tank, pumps, compressors, and other equipment for treating and handling the heavy hydrocarbons and byproducts of the recovery system.

Various advantages of particular aspects of the invention may include: a reduction in the volume of fine tailings produced by bitumen extraction and sent to tailings ponds, increased bitumen recovery, capture of a portion of the fines in the PFT process leading to a reduction in fine tailings that are sent to tailing ponds, and a reduction or elimination of the need for dilution water (make-up water) and therefore a reduction in the water usage. Other advantages may include a reduction in heating requirements, since the fine tailings streams are typically warm and may require less heating prior to introduction into the PFT process.

BRIEF DESCRIPTION OF THE DRAWINGS

Other aspects and features of the present disclosure will become apparent to those ordinarily skilled in the art upon review of the following description of specific embodiments in conjunction with the accompanying Figures.

DETAILED DESCRIPTION

Figure 1:
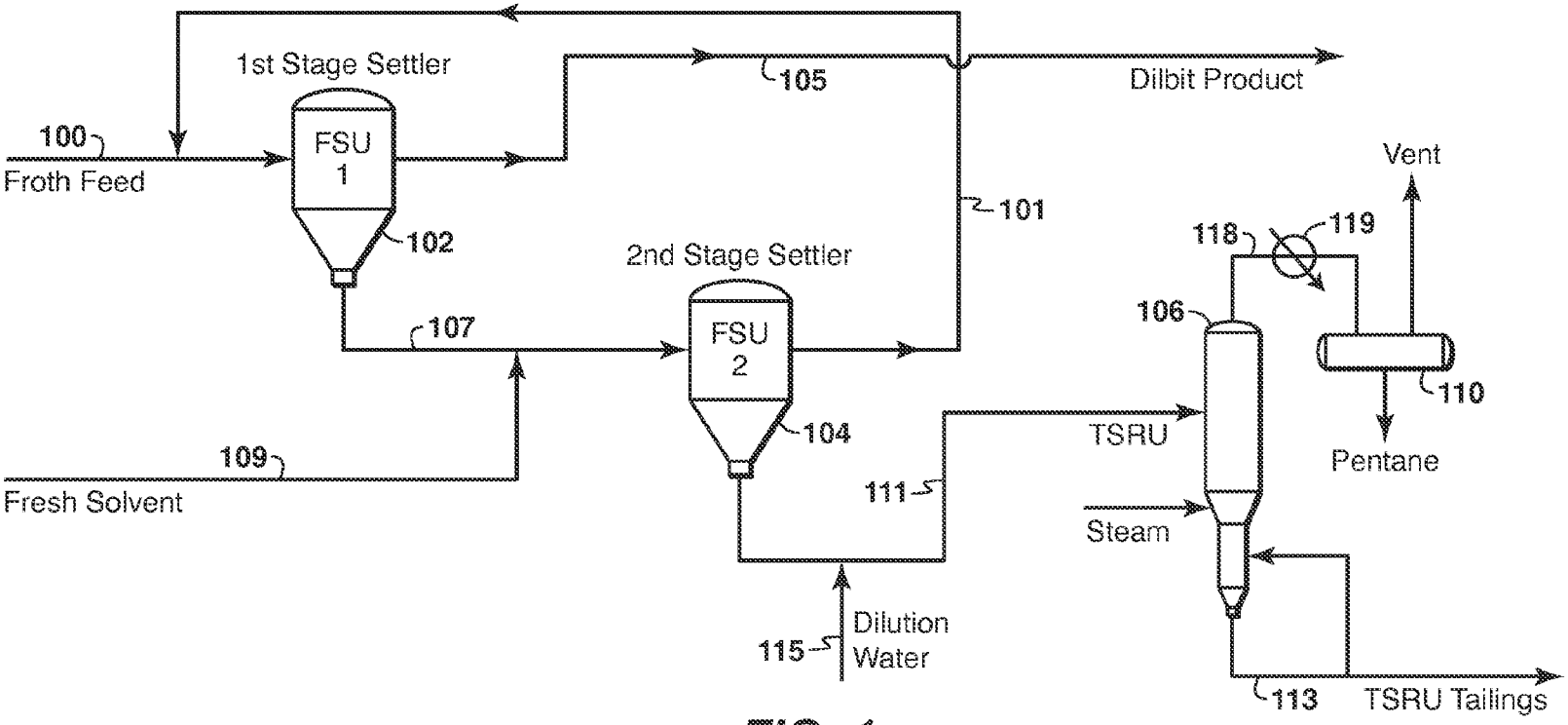
FIG. 1 (Prior Art)
FIG. 1 (prior art) is a schematic of a paraffinic froth treatment process of the prior art.

In the following detailed description section, the specific embodiments of the present invention are described in connection with preferred embodiments. However, to the extent that the following description is specific to a particular embodiment or a particular use of the present invention, this is intended to be for exemplary purposes only and simply provides a description of the exemplary embodiments. Accordingly, the invention is not limited to the specific embodiments described below, but rather, it includes all alternatives, modifications, and equivalents falling within the scope of the appended claims.

Unless otherwise explained, all technical and scientific terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. The term "includes" means "comprises".

The term "paraffinic solvent" (also known as aliphatic solvent) as used herein means solvents comprising normal paraffins, isoparaffins and blends thereof in amounts greater than 50 weight percent (wt %). The presence of other components such as olefins, aromatics or naphthenes counteracts the function of the paraffinic solvent and hence should not be present in more than 1 to 20 wt % combined and preferably, no more than 3 wt % is present. The paraffinic solvent may be a $C_4$ to $C_{20}$ paraffinic hydrocarbon solvent or any combination of iso and normal components thereof. In one embodiment, the paraffinic solvent comprises n-pentane, iso-pentane, or a combination thereof. In one embodiment, the paraffinic solvent comprises about 60:40 weight ratio of n-pentane to iso-pentane, with none or less than 20 wt % of the counteracting components referred to above.

The term "bitumen" as used herein refers to heavy oil having an API gravity of about 12° or lower. In its natural state as oil sands, bitumen generally includes fine solids such as mineral solids and asphaltenes, but as used herein, bitumen may refer to the natural state or a processed state in which the fine solids have been removed and the bitumen has been treated to a higher API gravity. Bitumen generally comprises asphaltenes and maltenes.

The term "asphaltenes" as used herein refers to hydrocarbons, which are the n-heptane insoluble, toluene soluble component of a carbonaceous material such as crude oil, bitumen or coal. Generally, asphaltenes have a density of from about 0.8 grams per cubic centimeter (g/cc) to about 1.2 g/cc. Asphaltenes are primarily comprised of carbon, hydrogen, nitrogen, oxygen, and sulfur as well as trace vanadium and nickel. The carbon to hydrogen ratio is approximately 1:1.2, depending on the source.

The term "maltenes" as used herein refers to the fraction of bitumen which is soluble in a paraffinic solvent. Maltenes have a lower molecular weight than asphaltenes.

The term "tailings" as used herein refers to a combination of water, sand, silt and/or fine clay particles that are a byproduct of extracting the bitumen from the oil sands.

A "fine tailings" stream is defined as any stream from an oil extraction process comprising fine solids. Fine solids typically have a dimension of less than 44 microns. Typically, the stream will comprise greater than 50% water, or may comprise 70-90% water, or may comprise about 76% water, in addition to the fine particles. Most of the solids in the fine tailings stream are fines (i.e. less than 44 microns), such that greater than 60% of the solids are fines, or greater than 70%, greater than 80%, or greater than 90 wt % of the solids are fines. These percentages are all weight based. The fine particles are typically clay, quartz, and sand. In addition, the stream may comprise residual bitumen, including asphaltenes. A typical fine tailings stream comprises about 76 wt % water, 8 wt % sand, 15.5 wt % fines, and 0.5 wt % bitumen.

An example of a prior art PFT process is described further to assist in understanding how the process may be operated. The PFT process typically consists of at least three units: Froth Settling Unit (FSU), Solvent Recovery Unit (SRU) and Tailings Solvent Recovery Unit (TSRU). Two FSUs are sometimes used, as described in the example below.

With reference to FIG. 1, a schematic of an exemplary prior art high-temperature paraffinic froth treatment is illustrated. The bitumen froth is provided from a heavy hydrocarbon recovery process. In the FSU unit, mixing of solvent with the feed bitumen froth (100) is carried out in two stages with FSU-1 and FSU-2, labeled as Froth Settling Unit 1 (102) and Froth Settling Unit 2 (104). In FSU-1 (102), the froth (100) is mixed with the solvent-rich oil stream (101) from the second stage (FSU-2) (104). The temperature of FSU-1 (102) is typically maintained at about 70° C. The overhead from FSU-1 (102) is the diluted bitumen product (105) and the bottom stream from FSU-1 (102) is the underflow or tailings (107) comprising water, solids (inorganics), solvent and some residual bitumen (said bitumen comprising both maltenes (desirable) and asphaltenes (undesirable)). The remaining maltenes from this bottom stream are further extracted in FSU-2 (104) by contacting them with fresh solvent (109). The solvent-rich oil (overhead) (101) from FSU-2 (104) is mixed with the fresh froth feed (100) as mentioned above. The bottom stream from FSU-2 (104) is the PFT underflow (111) comprising solids, water, asphaltenes and residual solvent (to be recovered in the Tailings Solvent Recovery Unit (TSRU) (106)). The recovered residual solvent (118) passes through a condenser (119) into a solvent storage (110) from where it can be cycled back into process (109). To avoid foaming and plugging within the TSRU, hot process water (e.g. 90° C.) (also called dilution water) (115) is added to the PFT underflow before entering the TSRU. Often there are two TSRUs in succession to improve solvent recovery. The ratio of this water to PFT underflow is typically about 1:1. The solvent-free slurry leaving the TSRU is known as TSRU tailings (113), and is generally disposed of in tailings ponds.

Figure 2:
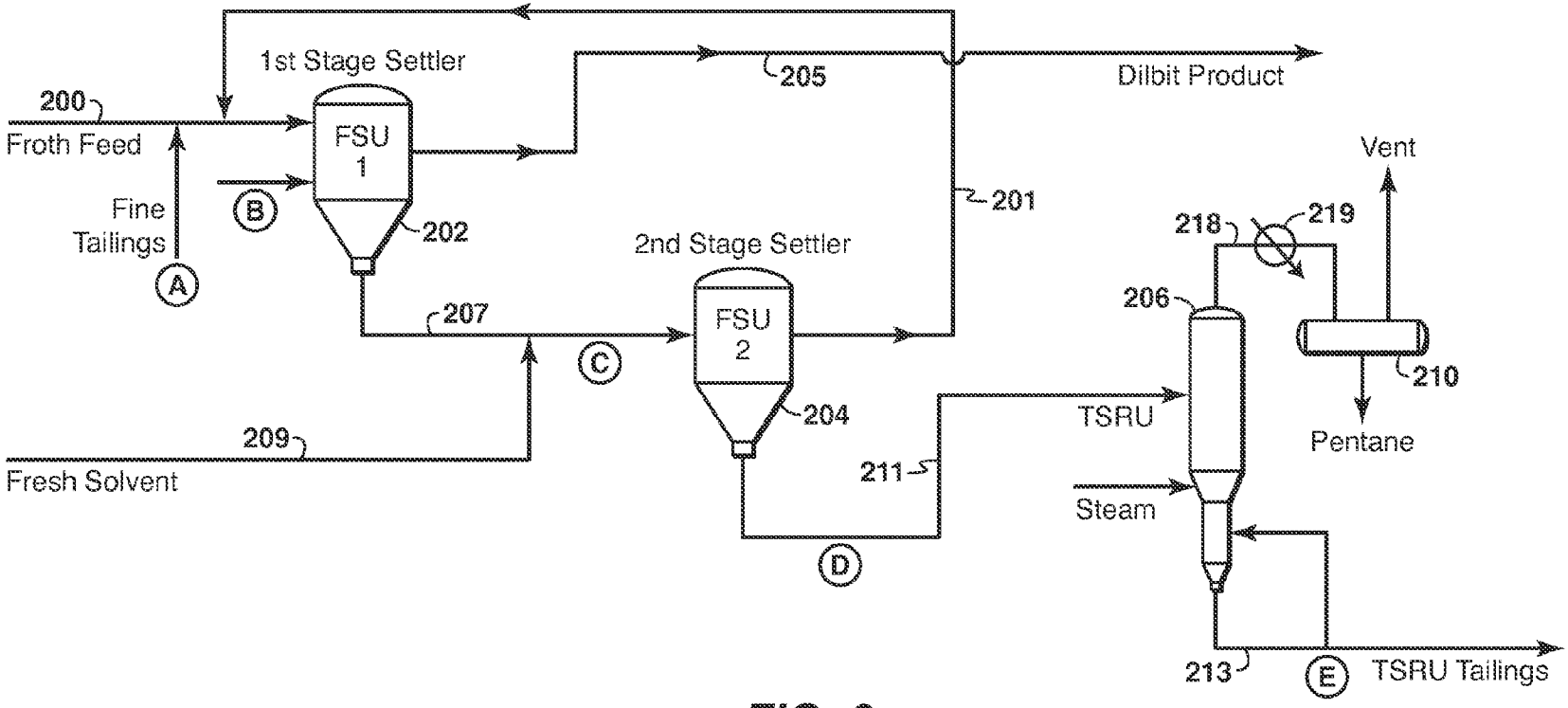
FIG. 2 is a schematic of a paraffinic froth treatment process in accordance with an embodiment of the invention.

FIG. 2 is an exemplary schematic of a process in accordance with one aspect of the invention utilizing at least a portion of the equipment disclosed in FIG. 1. As such, FIG. 2 may be best understood with reference to FIG. 1. The bitumen froth is provided from a heavy hydrocarbon recovery process. In the FSU unit, mixing of solvent with the feed bitumen froth (200) is carried out in two stages with FSU-1 and FSU-2, labeled as Froth Settling Unit 1 (202) and Froth Settling Unit 2 (204). In FSU-1 (202), the froth (200) is mixed with the solvent-rich oil stream (201) from the second stage (FSU-2) (204). The temperature of FSU-1 (202) may be maintained at about 60 to 80 degrees Celsius (° C.), or at about 70° C., and the target solvent to bitumen ratio is about 1.4:1 to 2.2:1 by weight or about 1.6:1 by weight. The overhead from FSU-1 (202) is the diluted bitumen product (205) and the bottom stream from FSU-1 (202) is the underflow or tailings (207) comprising water, solids (inorganics), solvent and some residual bitumen (said bitumen comprising both maltenes and asphaltenes). The remaining maltenes from this bottom stream are further extracted in FSU-2 (204) by contacting them with fresh solvent (209), for example in a 25:1 to 30:1 by weight solvent to bitumen ratio, and at, for instance, 80 to 95° C., or about 90° C. The solvent-rich oil (overhead) (201) from FSU-2 (204) is mixed with the fresh froth feed (200) as mentioned above. The bottom stream from FSU-2 (204) is the tailings or PFT underflow (211) comprising solids, water, asphaltenes and residual solvent, which is to be recovered in the Tailings Solvent Recovery Unit (TSRU) (206). Often there are two TSRUs in succession to improve solvent recovery. The recovered residual solvent (218) passes through a condenser (219) into a solvent storage (210) from where it can be cycled back into process (209). The solvent-free slurry leaving the TSRU is known as TSRU tailings (213). Exemplary operating pressures of FSU-1 (202) and FSU-2 (204) are respectively 550 kPag and 600 kPag. FSU-1 (202) and FSU-2 (204) are typically made of carbon-steel but may be made of other materials.

The process shown differs in at least one aspect from FIG. 1 in that the dilution water (115) shown in FIG. 1 is supplemented or replaced by a fine tailings stream (FT) obtained from a water extraction process practiced on oil sands. The fine tailings stream (FT) may be added to the process at any point in the process and may be added at one or at multiple locations in the process. Examples of such locations are one or more of the following locations.

Location A: The fine tailings stream (FT) may be added to the bitumen froth (200) before adding the paraffinic solvent (201), or may be added to the solvent bitumen froth mixture before the solvent bitumen froth mixture is processed in the first settling unit. In some embodiments, ratios of the fine tailings stream (FT) to the bitumen froth are froth/fine tailings=1.5-2.5, possibly ~2.

Location B: The fine tailings stream (FT) may be added directly to the first settling unit (202). Preferred ratios of the fine tailings stream (FT) to the bitumen froth are froth/fine tailings=1.5-2.5, possibly ~2.

Location C: The fine tailings stream (FT) may be added to the first settling tailings stream (207) before the first settling tailings stream (207) is added to the second settling unit (204). The addition may occur before the fresh solvent (209) is added to the first settling tailings stream (207), after the fresh solvent (209) is added to the first settling tailings stream (207), or the fresh solvent (209) and the fine tailings stream (FT) may be combined together prior to adding the mixture to the first settling tailings stream (207). In some embodiments, ratios of the fine tailings stream (FT) to the first settling tailings stream (207) are first settling tailings stream/fine tailings=0.7-1.5; possibly 0.9.

Location D: The fine tailings stream (FT) may be added to the second settling tailings stream (211) before the second settling tailings stream is added to a tailings solvent recovery unit (206). In some embodiments, ratios of the fine tailings stream (FT) to the second settling tailings stream (211) are second settling tailings stream/flotation tailings=0.5-1.5; possibly 1. In one embodiment, the fine tailings stream may be added at location D, in place of all or part of the dilution water.

Location E: The fine tailings stream (FT) may be added to the tailings stream (213) from the tailings solvent recovery unit (206).). In some embodiments, ratios of the fine tailings stream (FT) to the tailings stream (213) are tailings stream (213)/flotation tailings=0-2. Addition of the fine tailings at this point can result in the fine tailings being combined with the TSRU tailings that exit the process, or the fine tailings stream can be redirected into the base of the TSRU. High asphaltene content in the TSRU often results in foaming and plugging, and this problem is especially prevalent at the base of the TSRU where the diameter is small. Addition of tailings at this point can increase the flow rate and help remove the asphaltenes from the sides of the TSRU, reducing foaming and plugging. In addition, the asphaltenes in the TSRU tailings stream help flocculate fines in the fine tailings stream, such that when the fine tailing stream reaches tailings ponds a portion of the fines will have been flocculated (i.e. captured by the asphaltenes), advantageously increasing the rate of particle settling in the tailings ponds.

In a further embodiment, there may be multiple injection points at any, several, or all of these locations, or at any other location in the process. The ratios added at various locations may be the same or different. Addition of fine tailings to the process may in one embodiment mean that the dilution water can be supplemented or replaced entirely by the fine tailings stream. An advantage of such an embodiment is that there is a reduced need for fresh water resources.

The fine tailings stream is characterized by fine particles that are less than 44 microns in diameter. Typically, the stream will comprise greater than 50% water, or may comprise 70-90% water, or may comprise about 76% water, in addition to the fine particles. Most of the solids in the fine tailings stream are fines (i.e. less than 44 microns), such that greater than 60% of the solids are fines, or greater than 70%, greater than 80%, or greater than 90 wt % of the solids are fines. These percentages are all weight based. The fine particles are typically clay, quartz, and sand. In addition, the stream may comprise residual bitumen. A typical fine tailings stream comprises about 76 wt % water, 8 wt % sand, 15.5 wt % fines, and 0.5 wt % bitumen.

The fine tailings stream can be obtained from any water extraction process practiced on oil sands. During the hot-water bitumen extraction process, such as the Clark process, a middlings stream is collected from a primary separation vessel (PSV). In some processes, this middlings stream may be subjected to a second froth flotation treatment. This secondary treatment in turn also generally produces a fines stream known as flotation tailings or fine tailings. In one embodiment, the present invention contemplates use of part or all of one or both of these streams (i.e. the middlings stream and/or the flotation tailings stream) as a fine tailings stream. In one aspect, the fine tailings stream is obtained from a hydrocyclone overflow (to minimize the coarse solid content of tailings). In another aspect, the fine tailings stream is diluted mature fine tailings (MFT) at high temperature. MFT would generally need to be diluted and heated to be used in the process of the present invention. MFT can be obtained from tailings ponds by methods known in the art, such as dredging to take and pump the MFT from the ponds.

The injection of the middlings stream into the PFT process may eliminate or reduce the need for a second froth flotation treatment, as the PFT process can be used to treat the middlings tailings (i.e. to recover the residual bitumen in middling stream). For instance, in one embodiment, the fine trailings stream is processed in either or both the FSU-1 and FSU-2. Addition of paraffinic solvent to these units causes the maltene fraction of bitumen to dissolve and precipitate a fraction of the asphaltene content of bitumen. The precipitating asphaltenes have the ability to flocculate with the water droplets and solid particles and form rapid settling solids (i.e. the PFT underflow). The fines present in the fine tailings streams, especially the clays, will thereby agglomerate with the asphaltenes in the flocculating particles. The PFT underflow and the TSRU tailings are much easier to dispose of than fine tailings, because the particles are larger (e.g. asphaltene agglomerates) and can more readily be separated/settled from the water fraction.

The fine tailings stream can be heated to the desired temperature depending on the point of entry into the PFT process. For instance, as the temperature of the FSU-1 in HT-PFT is typically at about 60 to 80° C., more typically at about 70° C., it is preferable that the fine tailings, when being injected at Location A, be introduced at this or close to this temperature. This may be achieved by any number of methods known in the art for increasing the temperature of a slurry, including heating the fine tailings stream directly using a steam sparger, heating the bitumen froth stream (200) or the solvent stream (201) coming into the FSU-1, or by pre-combining the fine tailings stream with the solvent such that this mixture is at the desired temperature. It may be desirable to add the solvent after injection of the fine tailings stream into the bitumen froth stream to avoid precipitation of asphaltenes prior to entrance into the FSU-1. When injecting the fine tailings at Location B, it is similarly preferable that they be warmed to an appropriate temperature.

When injecting the fine tailings stream at Location C, the FSU-2 is typically at a temperature of 80 to 100° C., or about 90° C. Thus, it may be desirable to heat the fine tailings being introduced at this site. This may be achieved by any number of methods, as discussed above, including heating the fine tailings stream directly using a steam sparger, heating the FSU-1 tailings (207) or the fresh solvent stream (209) coming into the FSU-1, or by pre-combining the fine tailings stream with the fresh solvent, which may be superheated, such that this mixture is at the desired temperature. It may be desirable to add the solvent after injection of the fine tailings stream into the FSU-1 tailings to avoid precipitation of asphaltenes prior to entrance into the FSU-1.

Heating of the fine tailings stream injected at location D may be beneficial. Generally, the fine tailings stream would be pre-heated to the temperature of the second settling tailings stream (211).

Heating of the fine tailings stream injected at location E may be not required.

One advantage of the PFT process is the ability to process bitumen froth with high solids content. Thus, the addition of fine tailings stream to the PFT process does not typically present an additional burden on the PFT process.

In one aspect, the PFT process described herein may be a low-temperature PFT process, but is preferably a high-temperature PFT (HT-PFT) process.

The fine tailings may supplement or replace the process water or fresh water typically added to PFT process. The fine tailings may be directed to a single point in the PFT process or may be split into multiple streams and added at multiple points in the process.

The above-described embodiments are intended to be examples only. Alterations, modifications and variations can be effected to the particular embodiments by those of skill in the art without departing from the scope, which is defined solely by the claims appended hereto.

The invention claimed is:

1. A paraffinic froth treatment process wherein a fine tailings stream obtained from a water extraction process practiced on oil sands is added during the process, wherein the fine tailings stream excludes tailing solvent recovery unit (TSRU) tailings.

2. The paraffinic froth treatment process according to claim 1, wherein the fine tailings stream obtained from a water extraction process practiced on oil sands is one of (i) a middlings stream from a primary separation vessel in a water-based bitumen extraction process, (ii) a stream of fine tailings obtained from a secondary separation vessel in a water-based bitumen extraction process, (iii) a combination of a middlings stream from a primary separation vessel and a stream of fine tailings obtained from a secondary separation vessel in a water-based bitumen extraction process, (iv) a hydrocyclone overflow and (v) diluted mature fine tailings (MFT).

3. The paraffinic froth treatment process of claim 1, wherein the fine tailings stream comprises fine solids with an average size of less than 44 microns.

4. The PFT process according to claim 1, wherein the fine tailings stream is selected from the group consisting of:

middlings stream from a primary separation vessel in a water-based bitumen extraction process, a stream of fine tailings obtained from a secondary separation vessel in a water-based bitumen extraction process, a combination of a middlings stream from a primary separation vessel and a stream of fine tailings obtained from a secondary separation vessel in a water-based bitumen extraction process, a hydrocyclone flow, and diluted mature fine tailings (MFT).

5. A paraffinic froth treatment process, comprising:

providing a bitumen froth comprising bitumen, mineral solids, and water;

adding a paraffinic solvent to the bitumen froth to form a solvent bitumen froth mixture; and processing the solvent bitumen froth mixture in at least a first settling unit such that at least a portion of asphaltenes are precipitated and at least a portion of the mineral solids settles, forming a diluted bitumen stream and a first setting tailings stream;

wherein a fine tailings stream obtained from a water extraction process practiced on oil sands is added during the process, and wherein the fine tailings stream excludes tailing solvent recovery unit (TSRU) tailings.

6. The process according to claim 5, further comprising processing the first settling tailings stream from first settling unit in at least a second settling unit to form a solvent rich oil stream and a second settling tailings stream; and processing the second settling tailings stream in a tailings solvent recovery unit (TSRU) to obtain a solvent stream and a TSRU tailings stream.

7. The paraffinic froth treatment process according to claim 6, wherein the fine tailings stream is added to (i) the bitumen froth before adding the paraffinic solvent, (ii) the solvent bitumen froth mixture before the solvent bitumen froth mixture is processed in the first settling unit, (iii) the first settling unit, (iv) the first settling tailings stream before the first settling tailings stream is added to the second settling unit, (v) the second settling unit, (vi) the second settling tailings stream before the second settling tailings stream is added to a tailings solvent recovery unit, (vii) the tailings stream from the tailings solvent recovery unit, (viii) above or below a feed injection point in the first or second settling vessel;

(ix) the solvent stream; or (x) a combination thereof.

8. The paraffinic froth treatment process according to claim 6, wherein the TSRU is comprised of a first TSRU and second TSRU.

9. The paraffinic froth treatment process according to claim 6, further comprising adding fresh paraffinic solvent to the first settling tailings stream prior to addition of said first settling tailings stream to the second settling unit.

10. The paraffinic froth treatment process according to claim 9, wherein the fine tailings stream is one of (i) mixed with the fresh paraffinic solvent prior to addition of both to the first settling tailings stream, (ii) added to the first settling tailings stream prior to the addition of the fresh paraffinic solvent thereto, (iii) added to the first settling tailings stream after the addition of the fresh paraffinic solvent thereto (iv) added to the first settling tailings stream in place of the addition of the fresh paraffinic solvent thereto and (v) added to the tailings stream from the tailings solvent recovery unit.

11. The PFT process according to claim 5, wherein the fine tailings stream is selected from the group consisting of:

middlings stream from a primary separation vessel in a water-based bitumen extraction process, a stream of fine tailings obtained from a secondary separation vessel in a water-based bitumen extraction process, a combination of a middlings stream from a primary separation vessel and a stream of fine tailings obtained from a secondary separation vessel in a water-based bitumen extraction process, a hydrocyclone flow, and diluted mature fine tailings (MFT).

12. A method of treating a fine tailing stream comprising directing the fine tailings stream into a paraffinic froth treatment process.

* * * * *